United States Patent [19]

Castel et al.

[11] Patent Number: 4,612,994

[45] Date of Patent: Sep. 23, 1986

[54] DEVICE FOR CONNECTING A COLLECTING HEAD INPUT TO THE WELL HEAD OUTPUT BY MEANS OF A MOBILE CONNECTOR CONNECTED TO A LOOPED DUCT

[75] Inventors: Yvon Castel; Michel Iato, both of Pau, France

[73] Assignee: Societe Nationale Elf Aquitaine (Production), Courbevoie, France

[21] Appl. No.: 631,227

[22] Filed: Jul. 16, 1984

[30] Foreign Application Priority Data

Jul. 26, 1983 [FR] France ..... 83 12331

[51] Int. Cl.[4] ..... E21B 43/013; E21B 43/01

[52] U.S. Cl. ..... 166/344; 166/346; 166/360

[58] Field of Search ..... 166/344, 338, 341, 342, 166/360, 346, 347, 351

[56] References Cited

U.S. PATENT DOCUMENTS

| | | | |
|---|---|---|---|
| 3,589,441 | 6/1971 | Brown et al. | 166/346 |
| 4,120,362 | 10/1978 | Chateau et al. | 166/339 |
| 4,190,114 | 2/1980 | Fisher et al. | 166/346 |
| 4,260,022 | 4/1981 | Van Bilderbeek | 166/339 |
| 4,274,664 | 6/1981 | Thominet | 166/346 |

FOREIGN PATENT DOCUMENTS

| | | | |
|---|---|---|---|
| 2009288 | 6/1979 | United Kingdom | 166/338 |

*Primary Examiner*—Stephen J. Novosad
*Assistant Examiner*—Bruce M. Kisliuk
*Attorney, Agent, or Firm*—Poms, Smith, Lande & Rose

[57] ABSTRACT

A device for connecting a collecting head input with the well head output by means of a movable connector connected to a looped duct, comprising a flexible connecting coupling formed by two horizontal loops surrounding the distribution block of the collecting head at different levels and connected by a vertical duct portion. The movable connector, for guiding same towards a receptacle-connector, rests on a fork integral with a lever hinged by means of a swivel joint, an intermediate point of the lever resting on one end of a hydraulic cylinder provided with a swivel joint, the other end of the hydraulic cylinder resting on the connection module being hinged by means of a swivel joint, the connector comprises at its periphery radical guide rollers cooperating with inclined ramps of the receptacle and grouped in pairs of superimposed rollers, of which the lower roller has a diameter less than that of the upper roller. With the loop configuration of the duct and the device for guiding the connector, the stresses in the duct due to the rotating movement of the connector during alignment of its axes with that of the receptacle may be reduced.

14 Claims, 8 Drawing Figures

9
9a
9b
9c
9d
8
7
6
5
4
3
2
1
17
16a
16b 16b
16a
18
17
14
5
14a 8
6
5
14
15
9c
9b
13
9d
11
3
4
"A"
2
9d
12
10
13

Fig. 5
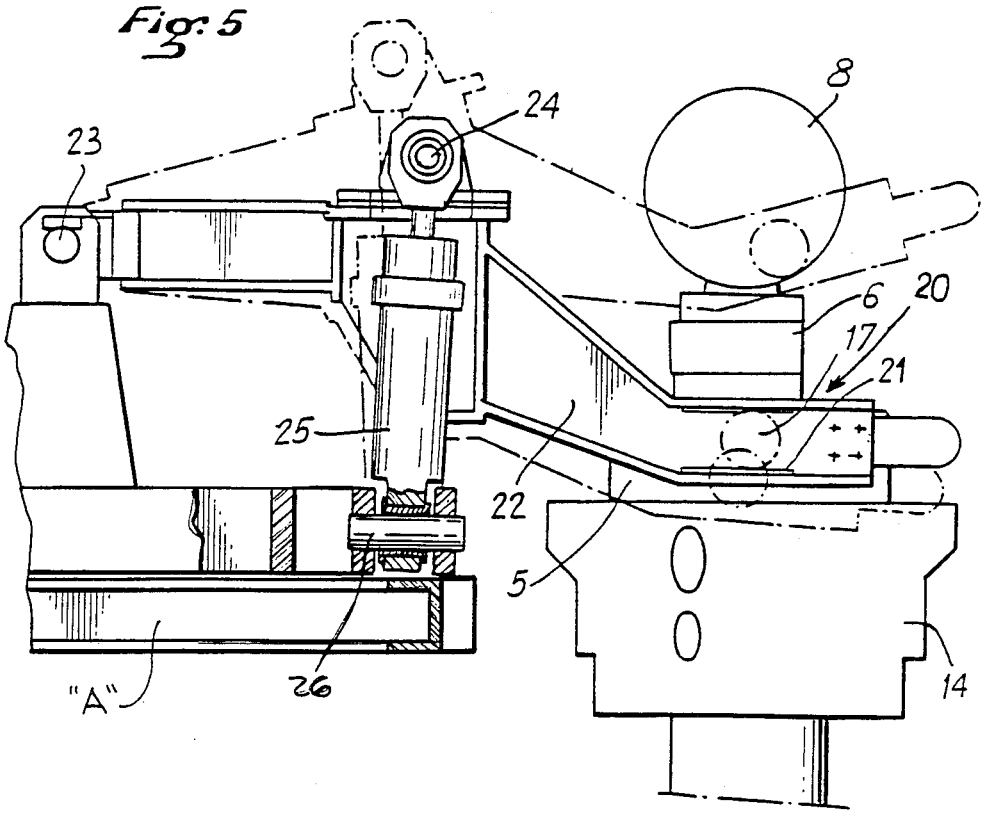
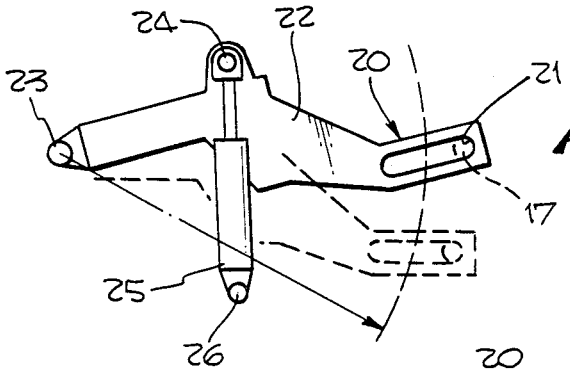
Fig. 6
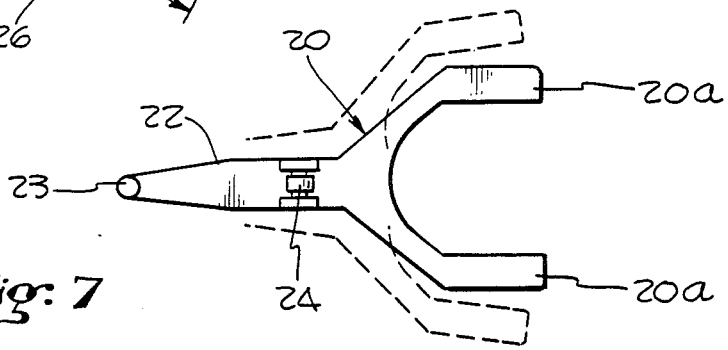
Fig. 7

DEVICE FOR CONNECTING A COLLECTING HEAD INPUT TO THE WELL HEAD OUTPUT BY MEANS OF A MOBILE CONNECTOR CONNECTED TO A LOOPED DUCT

BACKGROUND OF THE INVENTION

1. Field of the Invention

The present invention relates to a device for connecting a collecting head input to the well head output by means of a remote controlled mobile connector connected to the collecting head input by means of a looped duct.

2. Description of the Prior Art

During deep sea working, the approach of the connecting receptacle for a well head is a delicate operation. It is usually carried out by means of a connection module or production jumper unit (PJU) which serves for providing the oil connections between the well output and collector input mandrels. The ducts or fluid lines to be connected are multiple, such as the production duct, the duct for controlling the production duct-casing annulus and the duct for injecting treatment products.

Said connection module (PJU) has a structure adapted to handling, guiding on the guide columns and absorbing shocks. At its upper part, a solid plate serves as parachute in the case of a free fall in deep water. It also comprises studs for supporting the shock absorbers for positioning the upper modules, such as the handling module connecting operational module (COM) and the peripheral control module control jumper unit (CJU).

At the top, there is also provided an electro-hydraulic multi-connector for controlling the module during positioning by means of the COM or CJU. The connector and its guide means are carried by the PJU module. Positioning errors along the axes of translation x, y, z are of the order of 12 cm and in rotation about these axes ($O_x$, $O_y$, $O_z$) of the order of 1.5°.

Considering the fact that the connector is connected, before its connection with the well head, by ducts or pipe of relatively large diameter, for example of the order of 127 mm, to the input of the collecting head, turning moments generate high stresses, for example of the order of 20 kg/mm$^2$ for an axial rotation of 1.5°. To reduce this stress, it has been proposed giving the duct a looped shape, for example a double vertical or slanting loop, or a single horizontal loop, such solutions have proved insufficient. The aim of the present invention is to reduce the stresses in the ducts due to the turning movement of the connector during positioning thereof and to present the mobile connector correctly to the receiving mandrel. The aim sought is reached, in accordance with the invention, by a particular configuration of the loop and by means of a guide device imparting in a simple and reliable way to the connector straightening forces $F_x$, $F_y$, $F_z$ and torques $C_x$, $C_y$, $C_z$.

SUMMARY OF THE INVENTION

In the device of the invention for connecting a collecting head input having a distribution block and a handling arbor to the well head output by means of a movable connector forming part of the equipment of a connection module (PJU) and connected to the distribution block of the collecting head by means of a looped duct in accordance with the invention, the flexible connecting coupling is formed by two horizontal pipe loops surrounding the distribution block at different levels and connected together by a rectilinear vertical duct portion. The movable connector is guided towards a connector receptacle placed on the well head mandrel by a supporting fork integral with a lever hinged by means of a swivel joint for allowing rotating movements and deflections. An intermediate point of the lever rests on one end of a hydraulic cylinder provided with a swivel joint, the other end of the hydraulic cylinder resting on the module frame being also hinged by means of a swivel joint so as to allow height or vertical adjustment of the fork. The moveable connector carries at its periphery radial guide-rollers co-operating with inclined ramps with which the connector receptacle is provided and are grouped in pairs of superimposed rollers, the lower roller having a diameter less than that of the upper roller. The spacing between the ramps on the collecting input head providing a width greater than that of the throat of the ramp so that when the upper rollers bear on at least two opposite ramp inputs, positioning in the vertical plane is obtained and when, following lowering of the fork, a pair of lower rollers come into engagement at the bottom of the ramps, the coincidence of the axes of the connector and of the receptacle is attained.

Thus, the rotary forces and torques are generated from a single drive cylinder, a lever arm and receptacle equipped with guide ramps. In fact, movement along the vertical axis z is provided directly by the cylinder and the lever. The movements along the orthogonal horizontal axes z and y are generated by the connector rolling in the bell-mouthed receptacle surrounding the mandrel of the well head. The torque for straightening up about axis z is supplied by the action of the two opposite rollers, with which the connector is provided at its periphery, whereas the torques for straightening up about axes x and y are provided by reaction on the large and small roller torques.

The hydraulic cylinder and the lever impose movements without hindering the straightening up displacements and torques, because of the swivel joints placed at the two ends of the cylinder and at the position of the hinge of the lever, and also because of the method of supporting the connector inside the fork, namely by means of presser rollers, with which the connector is provided, sliding inside oblong shaped ramps presented by the fork.

BRIEF DESCRIPTION OF THE DRAWINGS

Other features of the invention will be clear from the following description of one embodiment of the device given by way of example illustrated by the drawings in which:

FIG. 5 is a partial sectional view of the mechanism for guiding the connector into alignment with the well head receptacle.

FIG. 6 is a schematic elevational view of a guide mechanism for the connector.

FIG. 7 is a schematic top plan view of the guide mechanism shown in FIG. 6.

DESCRIPTION OF THE PREFERRED EMBODIMENT

Figure 1:
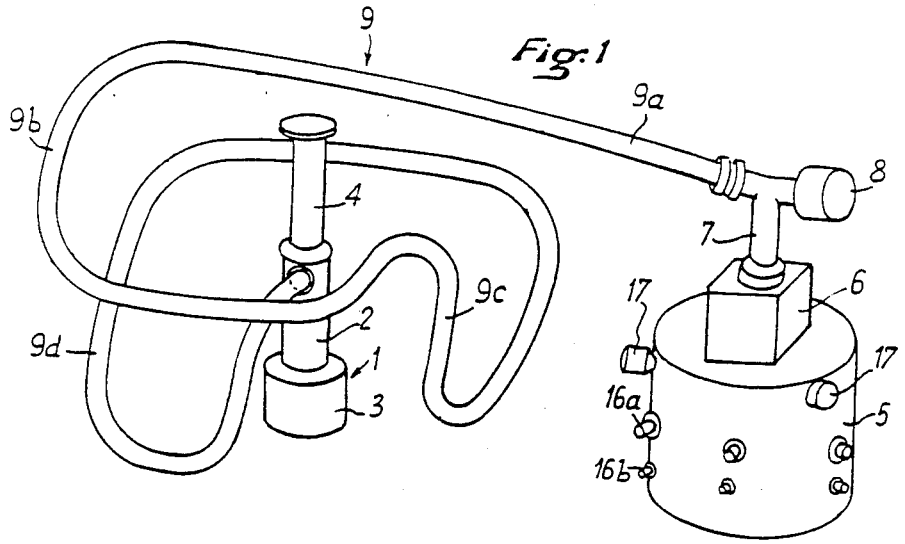
FIG. 1 shows in perspective the connector connected by a duct to the collecting head.

The collecting head 1 comprises a distribution block 2 placed on a collecting connector 3 over which is mounted a handling mandrel 4. The connector 5 for the well head has mounted thereon a distribution block 6 and an axial duct 7 leading to a nozzle 8 for controlling the flow of the well, integral with the block 6 and the discharge duct 9. Laterally, the ducts, not shown, for controlling the annulus and injection open into the block 6.

The duct 9 for discharging the production line has, after nozzle 8, a linear portion 9*a* for reducing the erosion effects of the duct at the output of the jets of the nozzle, a first horizontal loop of three quarters of a turn 9*b*, a rectilinear vertical portion 9*c*, and a second horizontal loop 9*d* of three quarters of a turn before joining up with the distribution block 2.

Figure 3:
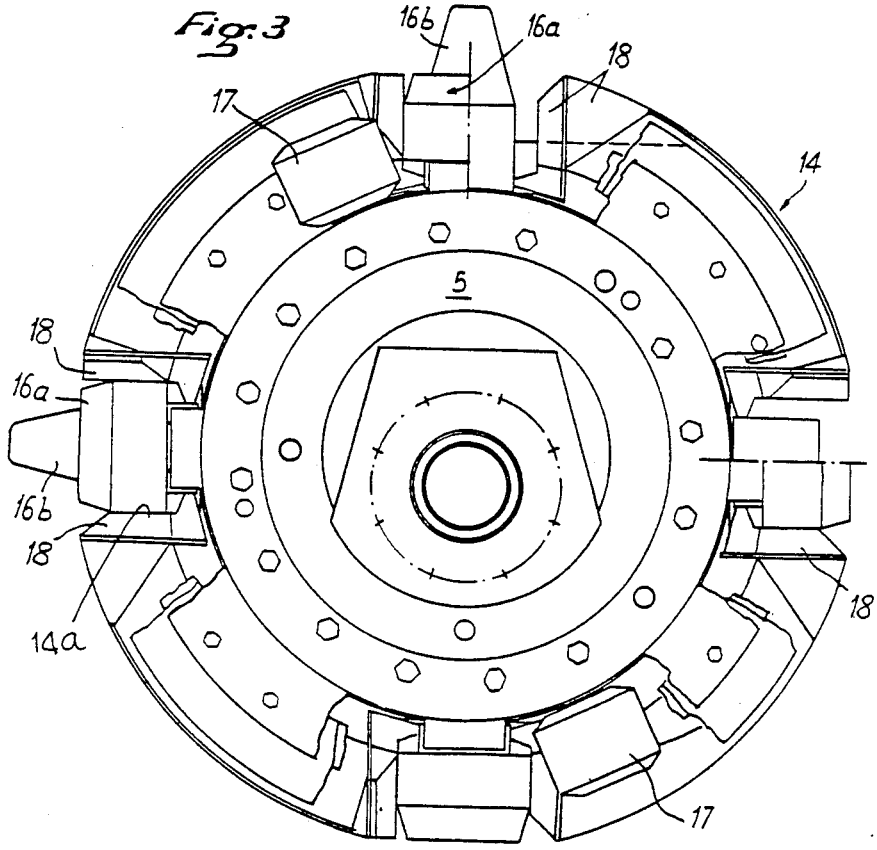
FIG. 3 is a top view of the connector housed in the receptacle.
Figure 2:
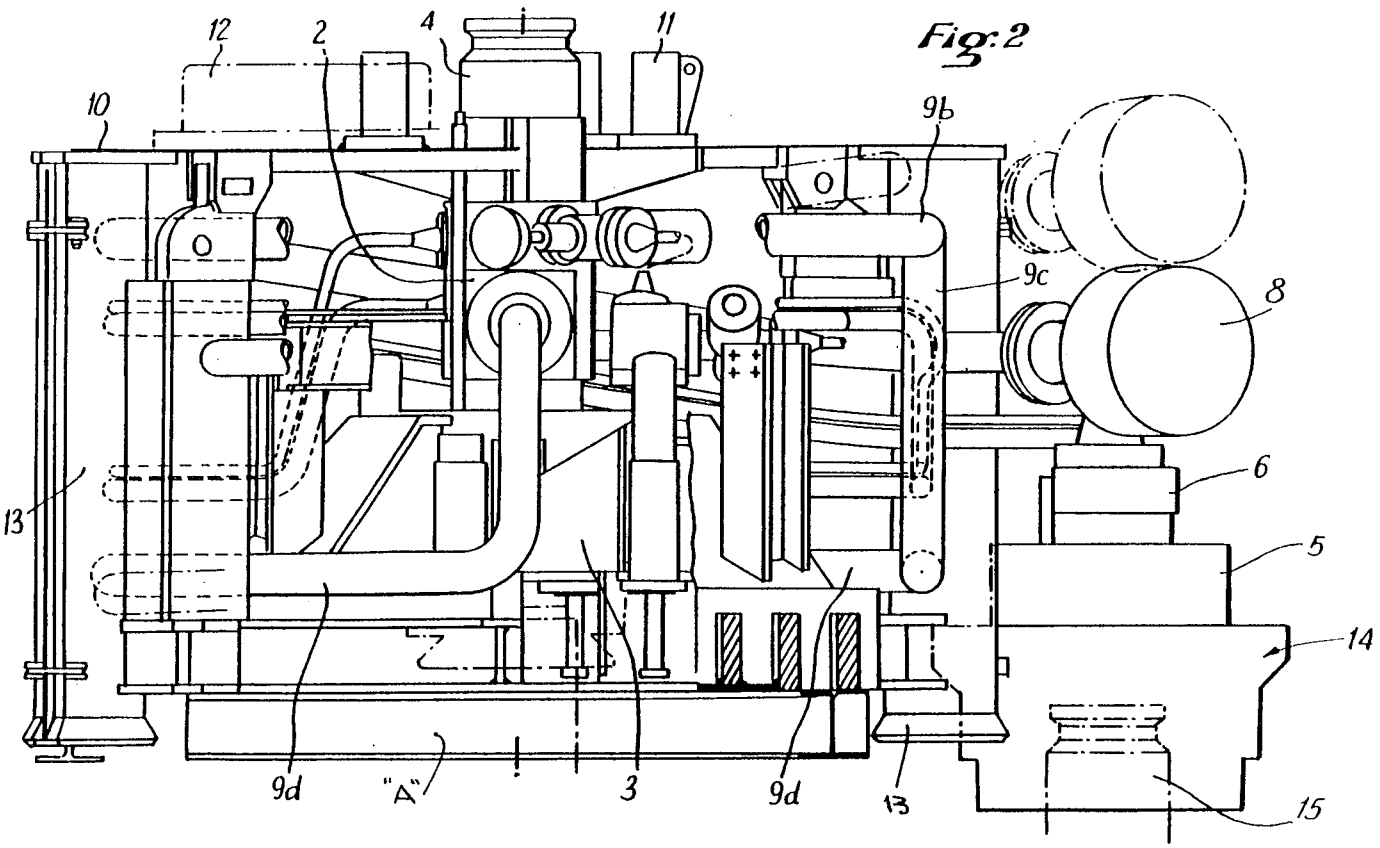
FIG. 2 shows an elevational view of the connection module and of the connector receptacle of the well head in assembled relation.
Figure 8:
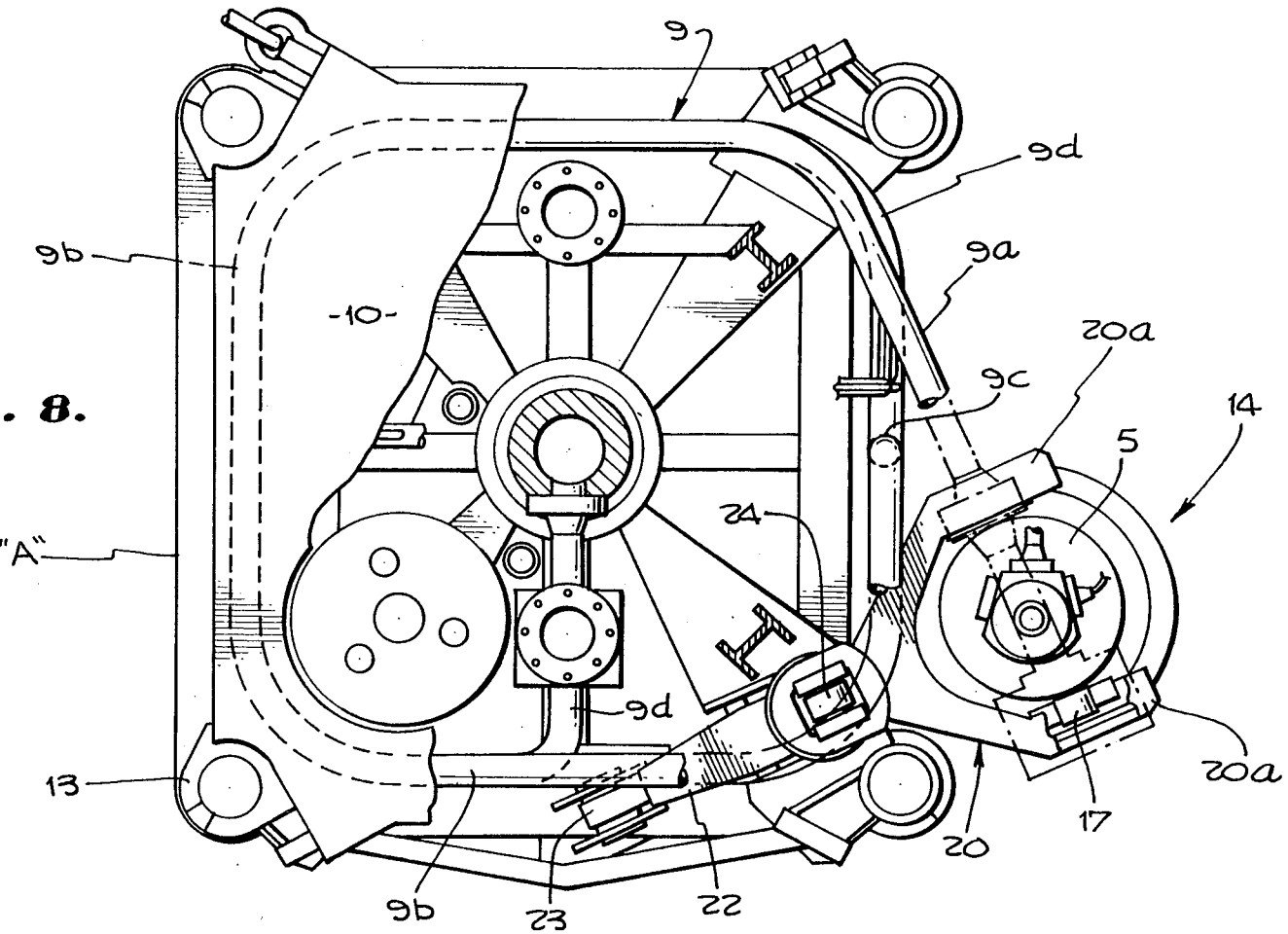
FIG. 8 is a top view of FIG. 2 with the top plate broken away and certain piping and devices carried by the connecting module being omitted for purposes of clarity.

On the collecting head 1 is placed a connection module A (FIGS. 2, 8) covered by an upper plate 10 having upstanding studs 11 for supporting the shock absorbers, not shown, for positioning upper modules and an electro-hydraulic multi-connector 12 indicated in phantom lines. At the periphery of connection module A are located guide tubes 13 for guide columns provided on a lower associated frame or module, not shown. The well head comprises a connector receptacle 14 surrounding a well head mandrel 15. Connector 5 is provided on its lower part with four pairs of outwardly projecting radial rollers, each pair of rollers having parallel axes aligned in a vertical plane passing through the axis of connector 5. The upper roller 16*a* of each pair has a diameter greater than that of the lower roller 16*b* of the pair. In two of the pairs out of the four pairs and particularly in adjacent pairs (FIG. 3), the lower roller 16*b* has a greater length than the other rollers so as to permit guiding of the longer rollers 16*b* without risk of jamming in hollow notches 14*a* of receptacle 14 so as to better accommodate or yield to adjusting movement of the single loop 9 and of the connector 5 during positioning of the connector 5 relative to the receptacle 14. At the upper periphery of the connector 5 are disposed diametrically opposite pressure rollers 17 for engagement by fork 20.

Figure 4:
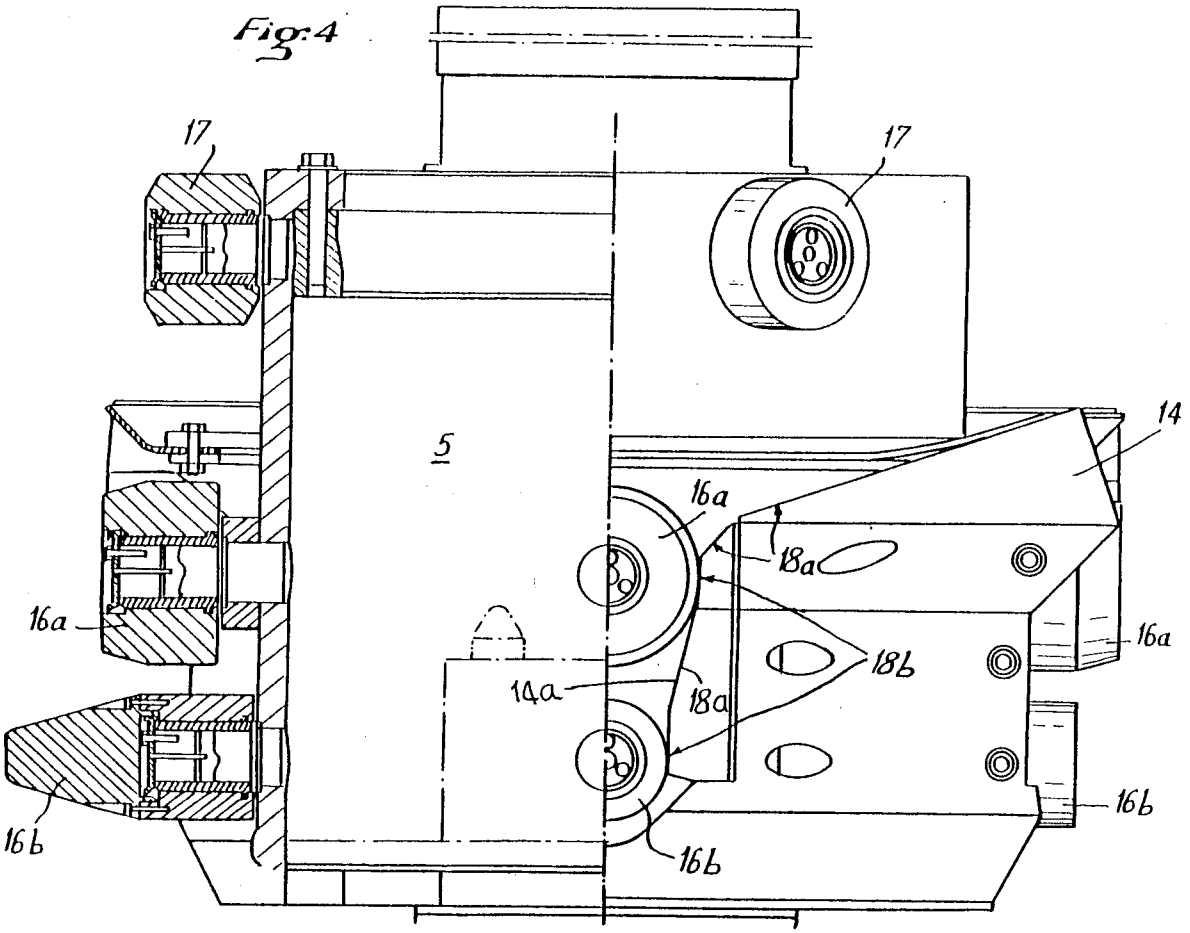
FIG. 4 is a side view in partial section of the connector housed in the receptacle.

Receptacle 14 is provided with four upwardly opening peripheral notches formed by ramps 18 and spaced at 90 degrees apart. The ramps of each notch provide, as seen from the side, inclined approach planes 18*a*, FIG. 4, and then inclined guide planes 18*b* which narrow the notch so that the axis of the large upper roller 16*a* may be aligned, in vertical plane, with that of the smaller lower rollers 16*b*, when this latter is engaged at the bottom of the groove defined by the ramps.

The connection module A contains the mechanism for guiding the connector 5. This guiding means comprises a fork 20 FIG. 5, in the legs 20*a* of which ramps 21 are formed in which the pressure rollers 17 are slidingly guided. In the extension of fork 20 is located a lever 22 integral with the fork and whose end is mounted on a swivel joint 23 supported from the frame of module A. Lever 22 is fixed by means of a swivel joint 24 to the end of a hydraulic cylinder 25, whose lower end is mounted on a swivel joint 26. The force of the hydraulic cylinder 25 is transmitted to connector 5 by means of presser rollers 17 housed in ramps 21 at the end of fork 20.

With swivel joint 23, fork 20 may be rotatably moved about the three axes x, y and z by the action of the hydraulic cylinder 25 and under the effect of the movement imposed by the movable connector whose rollers 16 engage ramps 18 and impose the axial alignment of the connector and of the receptacle. Swivel joints 24 and 26 placed at the ends of the hydraulic cylinder 25 are designed so as not to hinder such rotary movements of the fork.

At the beginning of the connection operation, module A is lowered by suitable guidelines so that the guide tubes 13 slide over guideposts or columns on a lower frame or module, not shown, until a selected position is reached such that connector 5 is approximately within ten centimeters more or less from the mandrel 15 of the well head and receptacle 14. In such position misalignment of the axes of the well head and of the connector is at most equal to 1.5 degrees because of the initial positioning of module A on the guideposts. The purpose of the connecting operation is to connect three fluid input lines: first and more especially the production line along the axis; laterally thereof a second line for controlling a production casing annulus; and thirdly a line for injecting threatment products and causing such lines to coincide with three corresponding ports in connector 5. By actuation of hydraulic cylinder 25, the fork 20 and lever 22 on module A is lowered so that lower rollers 16*b* of connector 5 engage and move along the approach ramps 18 in the notches on receptacle 14. By reception of pairs of rollers 16*b* and 16*a* and in the notches providing ramps 18 in receptacle 14, a selected position of connector 5 is obtained with respect to a vertical plane passing through the vertical axis of the well head mandrel. The longer rollers 16*b* may first engage at least two adjacent ramps 18 and as connector 5 is further lowered, the pairs of rollers 16*a* and 16*b* engage all ramps 18.

With the rollers being formed in pairs, one roller of which has a small and the other a large diameter, when the pair of rollers are engaged at the bottoms of ramp 18, coincidence of the axes is attained, since the two rollers of the same pair have axes aligned on the axis of the connector and since the ramp axis represents the axis of the mandrel of the well head. When coincidence of the axes of the connector 5 and of the receptacle 14 is obtained, locking takes place automatically, by means of locking devices known per se with which the connector and the receptacle are provided. The connecting device of the invention, and more especially the automatic device bringing together and aligning the axes of the parts to be connected, is susceptible of numerous variants, which a man skilled in the art could make, particularly in so far as equivalent means are concerned, without departing from the scope and spirit of the invention.

What is claimed is:

1. In a device for connecting a collecting head input having a distribution block and handling arbor to a well head output by means of a movable connector having an axis forming part of the equipment of a connection module and connected to the distribution block of the collecting head by means of a looped duct, the provision of;

a flexible connectiong coupling formed by two horizontal loops surrounding the distribution block at different levels and connected together by a rectilinear vertical duct portion for guiding the movable connector towards a receptacle-connector having an axis placed on the well head output, said movable connector resting on a fork integral with a lever hinged by means of a swivel joint so as to allow lateral deflecting and rotary movements, an intermediate point of the lever resting on one end of a hydraulic cylinder provided with a swivel joint, the other end of the hydraulic cylinder resting on the module being also hinged by means of a swivel joint so as to allow height adjustment of the fork, said movable connector having at its periphery radial guide rollers cooperating with inclined input ramps defining a throat therebetween with which the receptacle connector is provided and grouped in pairs of superimposed upper and lower rollers, the lower roller having a diameter less than that of the upper roller, the spacing apart of the input ramps having a width greater than that of the throat of the ramps so that, when the upper rollers bear on at least two opposite input ramps, positioning in a vertical plane is obtained and when, following lowering of the fork, a pair of lower rollers are engaged at the bottom of the ramps, the coincidence of the axes of the movable connector and of the receptacle connector is attained.

2. The device as claimed in claim 1, wherein said connector is provided at its outer face with presser rollers, said fork being provided with legs having inside ramps for engagement with said presser rollers which slide therealong.

3. The device as claimed in claim 1, wherein said connection module comprises a handling arbor, a solid plate below said handling arbor and comprising studs for supporting shock absorbers for placement of an upper module, such as a handling module and a peripheral control module, an electro-hydraulic multi-connector for controlling the connecting module;

and guide tubes intended to receive guide columns for placing the upper modules.

4. The device as claimed in claim 1, wherein the connection of the movable connector to the receptacle connector by said looped duct includes circuits for a production duct, a duct of a production duct-casing annulus and a duct for injecting treatment products.

5. In combination with a connecting module for interconnecting fluid outputs from a connector receptacle on a well head to a collecting head on the module, the provision of:

a flexible connecting coupling means comprising a duct means connected at one end to the collecting head;

a movable connector connected to the other end of said duct means;

said duct means including horizontally disposed spaced loops and a vertically disposed duct portion;

and guide means on the module for aligning the movable connector with the connector receptacle;

said guide means including fork means connected with the movable connector for relative movement of the movable connector with respect thereto in one direction;

lever means carrying said fork means and mounted on said module for vertical and lateral movement of the fork means and connector;

and means on the connector receptacle cooperable with means on said movable connector for positioning said movable connector in said receptacle in axial alignment therewith.

6. The combination as claimed in claim 5 wherein the horizontal loops of said duct means encircle the collecting head more than once.

7. The combination as claimed in claim 5 wherein said guide means on said movable connector includes pairs of guide rollers angularly spaced about the periphery of said movable connector, each pair of guide rollers including an upper roller and a lower roller vertically spaced in the vertical plane of the axis of the connector;

and said means on said receptacle include vertically extending notches angularly spaced about the periphery of the receptacle in correspondence with the spacing of the rollers about said movable connector.

8. The combination as claimed in claim 2 wherein the lower roller of at least two pairs of rollers is provided a length greater than the upper roller of said pair.

9. The combination as claimed in claim 7 wherein each of said notches includes downwardly and inwardly converging ramps for engagement by said pair of rollers.

10. The combination as claimed in claim 7 wherein the lower roller of each pair has a smaller diameter than the upper roller of each pair;

said notches on said receptacle including downwardly inclined converging ramps, the lowermost ramp adjacent the bottom of the notch and an upper ramp adjacent the final position of the upper roller of each pair providing positioning of the movable connector into axial alignment with the connector receptacle.

11. The combination as claimed in claim 5 including means for mounting said lever means on said module for vertical and lateral movement of said forked means;

said lever mounting means including a swivel mounting on said module for one end of said lever means;

a piston and cylinder means intermediate ends of said lever means and having a swivel mounting to said lever means at one end and a swivel mounting at its lower end to said module.

12. The combination as claimed in claim 5 wherein said fork means and said movable connector means include externally projecting roller means on said connector means;

said fork means including spaced fork legs provided with slide ramps on internal faces thereof for reception of said rollers on said connector.

13. The combination as claimed in claim 5 wherein the connecting module includes a top plate, an upstanding mandrel extending above said top plate, upstanding studs extending above said top plate adapted to support shock absorbers for assembly of upper modules with said connecting module, an electro hydraulic multiconnector for controlling said connecting module, and guide tubes on said connecting module for reception of guide columns for locating and positioning said upper modules.

14. A combination as claimed in claim 5 wherein a movable connector carried by the end of said looped duct means includes fluid circuits for connecting production fluid, annulus fluid, and injected treatment products.

* * * * *